United States Patent [19]

Puff et al.

[11] 4,344,769

[45] Aug. 17, 1982

[54] PROCESS AND INSTALLATION FOR TREATING COKING COAL

[75] Inventors: Roger M. Puff, Freyming-Merlebach; Jean-Claude Kita, Forbach, both of France

[73] Assignee: Charbonnages de France, Paris, France

[21] Appl. No.: 183,416

[22] Filed: Sep. 2, 1980

[30] Foreign Application Priority Data

Sep. 10, 1979 [FR] France ..... 79 22546

[51] Int. Cl.[3] ..... C10L 5/16; C10L 5/22

[52] U.S. Cl. ..... 44/23; 44/2; 44/6; 201/23

[58] Field of Search ..... 44/6, 2, 23, 24; 201/23

[56] References Cited

U.S. PATENT DOCUMENTS

| | | | |
|---|---|---|---|
| 3,985,516 | 10/1976 | Johnson et al. | 44/6 X |
| 3,985,517 | 10/1976 | Johnson | 44/6 X |
| 4,030,983 | 6/1977 | Beck et al. | 201/40 X |
| 4,174,947 | 11/1979 | Delessard et al. | 241/17 X |

*Primary Examiner*—Carl F. Dees

*Attorney, Agent, or Firm*—Cushman, Darby & Cushman

[57] ABSTRACT

In the pre-heating of coal the coal is entrained and/or fluidized in a heat exchange chamber by a heat-transfer gas which pneumatically conveys the coal from the chamber through a duct to a separator in which the coal is separated from gas. A hydrocarbon binder in a liquid state is injected into the coal in the duct through which the coal is being pneumatically conveyed by the gas to the separator.

21 Claims, 1 Drawing Figure

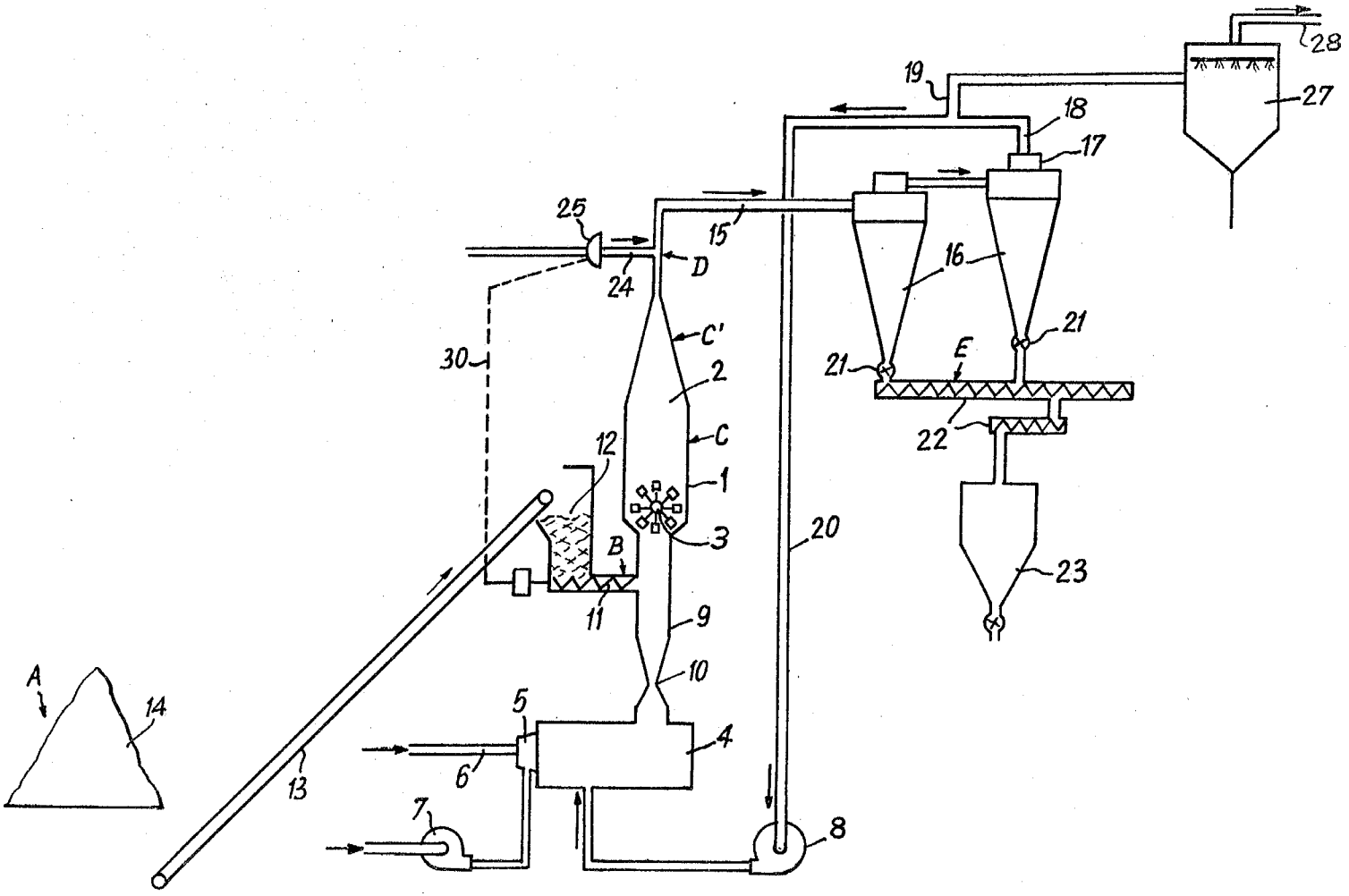
28
27
18
17
21
23
16
E
22
19
21
20
8
15
D
C'
2
C
1
3
9
10
4
24
B
12
11
25
5
6
30
7
13
14
A

PROCESS AND INSTALLATION FOR TREATING COKING COAL

BACKGROUND OF THE INVENTION

The present invention relates to a drying and/or preheating process for treating coal by entrainment and/or fluidisation in a chamber by means of a heat-transfer gas which is also used to convey the coal pneumatically out of the heat exchange chamber via a duct which brings it to a charging station via a separating device, in which process a hydrocarbon binder in liquid state is injected into the coal during the treatment. The present invention also relates to an installation for carrying out the process.

To improve the quality of coke obtained from dried coal, used in the iron and steel industry, French Pat. No. 1,265,397 proposes adding to the coal, before or after it has been dried, a hydrocarbon binder consisting of a coal tar pitch, an artificial pitch or a bitumen, or also an extract or extraction residue, the hydrocarbon binder being added so that the coal assumes a pasty or liquid consistency. A further known advantage of the introduction of a hydrocarbon binder is that it reduces the amounts of dust clouds when the coal is charged into the coke oven.

Published French Patent Application No. 2,326,464 proposes adding the hydrocarbon binder by spraying and/or by malaxating the coal, the binder being melted or brought into aqueous emulsion beforehand.

French Pat. No. 2,306,252 also proposed introducing the hydrocarbon binder into one of the conveyors of the already preheated coal, and to do this just before the coal is charged, in order to reduce the dust clouds during charging into the coke oven.

However, in the case of a preheating process of the type described above, all these known processes have disadvantages.

In fact, if the binder is introduced into the cold coal, that is to say before the coal is introduced into the dryer and/or preheater, the coal particles which are more or less impregnated with the hydrocarbon binder, are abruptly subjected to the high temperature of the drying and/or preheating fumes, which are sometimes at 600° or 800° C. The effect of this thermal shock is to vaporise some of the hydrocarbon binder, which therefore passes into the vapour phase and is not stopped by the electrofilters, and this reduces the efficiency of the process in preventing the clouds. Moreover, it has been observed that substantial deposits form in the dryer and/or preheater, to the extent of stopping the installation in the case where it is of the internal grinder type.

As regards the process for introducing the hydrocarbon binder into one of the conveyors of the already dried and/or preheated coal, it does not have the advantage of the previous processes, namely the improvement in the collecting efficiency of the separating cyclones.

The object of the invention is to provide a process and an installation which avoid the previous disadvantages, that is to say which simultaneously permit an improvement in the quality of the coke, a reduction in the clouds during charging, and good efficiency of the dust-removing cyclones and hence a reduction in the bulk of the latter.

A further object of the invention is to permit a reduction in the consumption of hydrocarbon binder whenever the quality of the coal to be charged allows. In other words, it must be possible to reduce the consumption of hydrocarbon binder to the amount which is strictly necessary both for good efficiency of the separating cyclones downstream of the dryer and/or preheater operating by entrainment and/or fluidisation, and consecutively for a reduction, or the elimination, of the dust clouds during charging into the oven.

SUMMARY OF THE INVENTION

According to one aspect of the present invention there is provided a process for treating coal, comprising:

(a) introducing coal into a chamber;
(b) passing gas through coal in the chamber to entrain the coal;
(c) pneumatically conveying the coal by means of the gas along a path from the chamber to separating means;
(d) introducing a hydrocarbon binder in a liquid state into said path for addition to the coal being conveyed;
(e) separating gas from the coking coal in the separating means; and
(f) removing the coking coal from the separating means for further treatment.

The hydrocarbon binder may be a molten product, such as pitch or bitumen, which has a softening point of between about 30° C. and 100° C., as determined in accordance with French Standard Specification No. T 66,008, and which preferably melts at a temperature between 150° C. and 260° C.

Alternatively, the hydrocarbon binder may be in the form of a liquid aqueous emulsion of bitumen, containing about 40% to 60% by weight of bitumen, the emulsion being of the type known for the cold coating of materials such as roadmaking aggregate.

According to another aspect of the present invention there is provided an installation for treating coking coal, comprising:

(a) a heat exchange chamber for the treatment of the coking coal;
(b) means for introducing into the chamber coking coal which is to be treated therein;
(c) means for introducing a heat-transfer gas into the chamber at an approximately constant rate, to entrain the coal which has been treated in the chamber;
(d) separating means for separating the entrained coal from gas;
(e) pneumatic conveying duct for conveying the gas-entrained coal from the chamber to the separating means; and
(f) means for introducing a hydrocarbon binder into said pneumatic conveying duct.

The means for introducing hydrocarbon binder may be a device with an adjustable output.

If the means for introducing the coal into the chamber has a known and/or adjustable output, the output of the means for introducing the hydrocarbon binder may be controlled by the output of the means for introducing the coal into the chamber, the means for introducing the hydrocarbon binder may be a device for introducing the binder in the molten state or in the form of a liquid emulsion, and this device may be a spraying device.

BRIEF DESCRIPTION OF THE DRAWING

An embodiment of the present invention will now be described by way of example and with reference to the accompanying drawing the single FIGURE of which shows a drying and/or preheating installation embodying the invention.

DESCRIPTION OF THE PREFERRED EMBODIMENT

On the whole, the invention is described for the case of its application to an installation in the same technical field as that of Published French Application No. 2,378,081.

An installation for the prior treatment of coal comprises a grinder/preheater 1 for grinding and preheating in a fluidised bed. This grinder/preheater 1 comprises a fluidisation, heat exchanger chamber 2 inside which a hammer grinder 3 rotates. The fluidising and heating gas for fluidising and preheating the coal is produced in a combustion chamber 4 by the combustion of gas which is brought to its burner 5 via a pipe 6, together with air delivered by means of a blower 7. Furthermore, the fumes originating from the prior treatment of the coal are recycled into the combustion chamber by means of a blower 8. The hot gases originating from the combustion chamber 4 are brought through a Venturi tube 10 to a vertical pipe 9 for pneumatic conveying and predrying, into which the coal stored in a hopper 12, to which it has been brought by means of a conveyor 13 from a storage yard 14, is fed by means of a screw conveyor 11. As is in itself known, the vertical pipe 9 emerges in the chamber 2 for fluidisation and for grinding and preheating. A duct 15, which extends from the top of the chamber 2, pneumatically conveys the ground coal, preheated by the fluidising gas, the latter again acting as a gaseous carrier. The duct 15 brings the carrier gas and the conveyed coal to a battery of cyclones 16; a pipe 18, which serves to collect the gases which are subsequently distributed into an extraction pipe 19 and a pipe 20 for recycling by means of the blower 8, being connected to the vortex 17 of the last cyclone or last group of cyclones. The preheated coal ready for charging into a coke oven is collected at the points 21 of the cyclones 16 and, for this purpose, it is brought by means of a conveying unit 22 to a hot-coal hopper 23.

According to the processes referred to above, it is known to introduce 0.5 to 3% by weight of a hydrocarbon binder, such as coal tar, into the conveyor unit 22, for example at E. However, although this does reduce the dust clouds on charging, it does not prevent the entrainment of an excessively large amount of dusts into the gases collected at the vortex of the last cyclone or last group of cyclones, whereupon coal is lost by entrainment or by degradation in the combustion chamber 4. It is also known to introduce 5% to 10% by weight of molten hydrocarbon binder into the cold coal, which is stored either in a yard 14, for example at A, or in a malaxating apparatus, such as the screw conveyor 11, that is to say at B. All the disadvantages of these known processes are discussed above.

According to the invention, a molten hydrocarbon binder, or a hydrocarbon binder in the form of a liquid emulsion of the type used for cold coating, is injected into the pneumatic conveying duct 15 for example at one or more points D, by means of one or more spray nozzles supplied by the feed pipe 24, the output of which can be adjusted by means of a valve 25. The adjustable output is controlled, via a circuit 30, by the rotation speed, and hence by the coal output, of the screw conveyor 11 for introducing the coal into the pipe 9, that is to say into the chamber 2, so that the proportion of binder introduced, relative to the coal treated, is 0.5% to 3% by weight and preferably 1% by weight.

With a bitumen which has a softening point of between 30% and 100° C. and which melts between 150° C. and 260° C., without however reaching its degradation temperature, and with an aqueous bitumen emulsion of the type used for coating roadmaking aggregate, which emulsion can be pumped and sprayed at ambient temperature and is used at ambient temperature, perfectly stable operation of the installation has been achieved with a level of dusts in the fumes of the order of 0.15 g/m$^3$N of dry fumes, the fumes being withdrawn at the outlet 28 of a wet scrubber 27 arranged on the extraction pipe 19. This result can be compared with that of about 1.0 g/m$^3$N of dry fumes, which is obtained without the introduction of binder. This result is totally surprising if it is compared with the result obtained with the introduction of the customary 6% by weight of bitumen, introduced in the yard (point A), and if reference is made to the unstable operation of the dryer and/or preheater in the case of the introduction of the hydrocarbon binder at B.

It would be possible to consider introducing the hydrocarbon binder into the chamber itself, for example at C. However, it has been found that, if the binder is introduced into the active zone of the grinder, that is to say into the zone in which insufficiently ground particles fall back into the chamber, unstable operation, associated with fouling of the grinding mechanism and of the walls, results. However, it would still be possible to conform to the teachings of the invention by introducing the binder from a point C′ of the chamber, at which the sufficiently ground coal has been entrained by the flow of gas directed towards the conveying duct 15. However, the determination of the start of the entrainment zone depends on too many parameters to enable an introduction point C′ to be singled out, unless this point C′ is so close to the connection zone between the chamber and the duct 15 that the gaseous fluid has already started to entrain, and that this connection zone is already in the pneumatic conveying zone to the point where, in a sense, it constitutes the start of the pneumatic conveying pipe.

The invention has been described for the case of a drying and/or preheating installation operating by fluidisation. It applies equally well to a drying and/or preheating installation operating by co-current entrainment by means of hot fumes.

We claim:

1. A process for treating coal, comprising the steps of:

(a) introducing coal into a preheater chamber;

(b) generating a hot combustion gas in a combustion chamber;

(c) passing said hot gas through the coal in said preheater chamber to preheat and entrain the coal contained therein;

(d) pneumatically conveying the coal by means of said gas along a path from said preheater chamber to a coal/gas separating means;

(e) introducing a hydrocarbon binder in a liquid state into said path by adding said liquid hydrocarbon binder to the coal being pneumatically conveyed in said path;

(f) separating gas from the coal in said separating means; and (g) removing the coal with hydrocarbon binder thereon from the separating means for further treatment.

2. A process according to claim 1, wherein the hydrocarbon binder is introduced into said path at a rate dependent upon the rate at which the coal is introduced into the chamber.

3. A process according to claim 1, wherein the hydrocarbon binder has a softening point of between about 30° C. and 100° C.

4. A process according to claim 3, wherein the hydrocarbon binder is pitch.

5. A process according to claim 3, wherein the hydrocarbon binder is bitumen.

6. A process according to claim 3, wherein the hydrocarbon binder is introduced at a temperature between about 150° C. and 260° C.

7. A process according to claim 1, wherein the hydrocarbon binder is a liquid aqueous emulsion of bitumen.

8. A process according to claim 2, wherein the hydrocarbon binder is added to the coal in a proportion by weight of 0.5% to 3%.

9. Process according to claim 8, wherein the proportion by weight is about 1% bitumen.

10. An apparatus for treating coking coal, comprising:

a heat exchanger chamber for the treatment of the coal;

means for introducing into the said heat exchange chamber coal which is to be treated therein;

combustion chamber means for burning gas in air and generating a heat transfer gas;

means for introducing said heat-transfer gas from said combustion chamber into said heat exchange chamber at an approximately constant rate, to entrain the coal which has been treated in said heat exchange chamber;

separating means for separating the entrained coal from gas;

a pneumatic conveying duct for conveying the gas-entrained coal from the chamber to the separating means; and means for introducing a hydrocarbon binder into said pneumatic conveying duct.

11. Apparatus according to claim 10, wherein the means for introducing the hydrocarbon binder comprises means for adjusting the rate of introduction of the binder.

12. Apparatus according to claim 11, wherein the means for adjusting the rate of introduction of the hydrocarbon binder is controllable in dependence upon the rate of introducing the coal into the heat exchange chamber.

13. Apparatus according to claim 10, wherein the means for introducing the hydrocarbon binder is adapted to introduce the binder in a molten state.

14. Apparatus according to claim 13, wherein the means is adapted to introduce the binder in the molten state is a spraying device.

15. Apparatus according to claim 10, wherein the means for introducing the hydrocarbon binder is adapted to introduce the binder in the form of a liquid emulsion.

16. Apparatus according to claim 15, wherein the means for introducing the binder in the form of a liquid emulsion is a spraying device.

17. A process for treating coking coal comprising the successive steps of:

(1) introducing coking coal into a grinder/preheater chamber having an internal grinder therein;

(2) producing hot combustion gas in a combustion chamber;

(3) passing said hot gas through coking coal contained in the grinder/preheater chamber to preheat and entrain the coking coal contained therein;

(4) pneumatically conveying the thus entrained coking coal by means of the said gas along the path from the grinder/preheater chamber to a separating means;

(5) introducing a hydrocarbon binder in a liquid state into said path by adding said liquid hydrocarbon binder to the coal being pneumatically conveyed in said path;

(6) separating gas from the coal in said separating means; and (7) removing the coal with hydrocarbon binder thereon from the separating means for further treatment.

18. A process according to claim 1 or 17 wherein the temperature of said hot gas directed into said preheater chamber is about 600° to about 800° C.

19. A process according to claim 18 wherein (i) the hydrocarbon binder has a softening point of between about 30° C. and 100° C., and (ii) the hydrocarbon binder is introduced in said passage at a temperature between about 150° C. and 260° C.

20. A process for treating coking coal comprising the successive steps of:

(1) introducing coking coal into a grinder/preheater chamber having an internal grinder therein;

(2) producing hot combustion gas having a temperature of about 600° C. to about 800° C. in a combustion chamber;

(3) passing said hot gas through coking coal contained in the grinder/preheater chamber to preheat and entrain the coking coal contained therein;

(4) pneumatically conveying the thus entrained coking coal by means of the said gas along a path from the grinder/preheater chamber to a separating means;

(5) introducing a hydrocarbon binder in a liquid state into said path at a temperature between about 150° C. and 260° C. by adding said liquid hydrocarbon binder to the coal being pneumatically conveyed in said path;

(6) separating gas from the coal in said separating means; and (7) removing the coal with hydrocarbon binder thereon from the separating means for further treatment.

21. An apparatus for treating coking coal, comprising:

heat exchange chamber for the treatment of the coking coal, said heat exchange means having an internal grinder therein;

means for introducing into the heat exchange chamber coking coal to be treated therein;

combustion chamber means for burning gas in air to generate a heat transfer gas therein;

means for introducing said heat-transfer gas from said combustion chamber into said heat exchange chamber at an approximately constant rate to heat and entrain the coal which has been treated in the chamber;

a pneumatic conveying duct for conveying the gas-entrained coal from the chamber to the separating means;

and means for introducing a hydrocarbon binder into said pneumatic conveying duct.

* * * * *